US008652975B1

(12) United States Patent
Atkinson et al.

(10) Patent No.: US 8,652,975 B1
(45) Date of Patent: Feb. 18, 2014

(54) FLAME RESISTANT FABRIC

(75) Inventors: Zeb W. Atkinson, Spartanburg, SC (US); Joseph B. Glenn, Belton, SC (US); Kimila C. Sasser, Cowpens, SC (US)

(73) Assignee: Milliken & Company, Spartanburg, SC (US)

( * ) Notice: Subject to any disclaimer, the term of this patent is extended or adjusted under 35 U.S.C. 154(b) by 27 days.

(21) Appl. No.: 13/602,947

(22) Filed: Sep. 4, 2012

Related U.S. Application Data

(63) Continuation of application No. 12/175,708, filed on Jul. 18, 2008, which is a continuation of application No. 11/183,571, filed on Jul. 18, 2005, now abandoned.

(51) Int. Cl.
*D03D 15/00* (2006.01)

(52) U.S. Cl.
USPC ..... 442/197; 442/181; 442/189

(58) Field of Classification Search
USPC ..... 442/181, 189, 197; 28/140, 143, 153, 28/157, 165, 169
See application file for complete search history.

(56) References Cited

U.S. PATENT DOCUMENTS

| | | | |
|---|---|---|---|
| 3,900,664 | A | 8/1975 | Miller |
| 3,987,613 | A | 10/1976 | Woods et al. |
| 4,035,542 | A | 7/1977 | Rosenthal et al. |
| 4,092,108 | A | 5/1978 | Valko et al. |
| 4,151,322 | A | 4/1979 | Rosenthal et al. |
| 4,154,890 | A | 5/1979 | Wagner |
| 4,419,401 | A | 12/1983 | Pearson |
| 4,513,042 | A | 4/1985 | Lumb |
| 4,748,996 | A | 6/1988 | Combier |
| 4,868,041 | A | 9/1989 | Yamagishi et al. |
| 4,920,000 | A | 4/1990 | Green |
| 4,966,800 | A | 10/1990 | Maix |
| 5,356,700 | A | 10/1994 | Tanaka et al. |
| 5,447,787 | A | 9/1995 | Shaffer |
| 5,482,763 | A | 1/1996 | Shaffer |
| 5,506,042 | A | 4/1996 | Ichibori et al. |
| 5,694,981 | A | 12/1997 | Stanhope et al. |
| 5,928,971 | A | 7/1999 | Ellis et al. |
| 5,958,804 | A | 9/1999 | Brown, Jr. et al. |
| 5,981,407 | A | 11/1999 | Matsumoto et al. |
| 6,296,023 | B1 | 10/2001 | Gehrhardt et al. |
| 6,297,178 | B1 | 10/2001 | Berbner et al. |
| 6,488,718 | B1 | 12/2002 | Rearick |
| 6,624,096 | B2 | 9/2003 | Thomas et al. |
| 6,626,964 | B1 | 9/2003 | Lunsford et al. |
| 6,666,235 | B2 | 12/2003 | Chi et al. |
| 6,668,868 | B2 | 12/2003 | Howland et al. |
| 2003/0228812 | A1 | 12/2003 | Stanhope et al. |

*Primary Examiner* — Andrew Piziali
(74) *Attorney, Agent, or Firm* — Robert M. Lanning

(57) ABSTRACT

The invention provides a flame resistant woven fabric comprising a plurality of first yarns and a plurality of second yarns, wherein the first yarns are disposed in a first direction in the woven fabric, the second yarns are disposed in a second direction in the woven fabric, and the second direction is substantially perpendicular to the first direction. The invention further provides a process for producing a flame resistant woven fabric.

11 Claims, No Drawings

FLAME RESISTANT FABRIC

CROSS REFERENCE TO RELATED PATENT APPLICATIONS

This application is a continuation of, and claims the benefit of the filing date of co-pending U.S. patent application Ser. No. 12/175,708, filed on Jul. 18, 2008, which application is a continuation of and claims the benefit of the filing date of U.S. patent application Ser. No. 11/183,571, filed on Jul. 18, 2005, now abandoned, each of which is hereby incorporated by reference.

FIELD OF THE INVENTION

The present invention relates to flame resistant fabrics and processes for producing the same.

BACKGROUND OF THE INVENTION

While it may be desirable that every fabric that is used in clothing be flame resistant, this requirement is clearly more important for some fabrics than others. For example, it is vital that the jackets and pants of firefighters be flame resistant. Also, the bedclothes of small children may benefit from being somewhat flame resistant. Street clothes, on the other hand, need not be flame resistant, especially if the fabric, when made flame resistant, adversely affects the more desirable qualities of street clothes, such as comfort, appearance, hand, and reasonable cost.

Military battle dress uniforms demand a compromise between a number of different and oftentimes competing requirements, especially uniforms worn by soldiers who operate battle vehicles. Battle dress uniforms must be durable, able to receive dyes and camouflage prints, and reasonably comfortable. Due to the battlefield conditions present, for example, inside a battle vehicle, it is also desirable for a military uniform to be flame resistant.

Flame resistant properties can be imparted to materials containing natural and synthetic fibers using well-known treatments. For example, a flame retardant finish can be applied to the surface of a fabric or to the fibers from which the fabric is made. However, after repeated washings, the ability of such treated fabrics to resist fire and flames can be significantly compromised or entirely eliminated.

Fabrics have been developed which exhibit flame resistant properties without applying a flame retardant finish to the fabric. For example, fabrics made from certain aromatic polyamide fibers, such as NOMEX® fibers commercially available from DuPont, are resistant to heat and flame without the application of a flame retardant finish. While fabrics made from such flame resistant aramid fibers may exhibit desirable flame resistance, such fabrics can be difficult to print on and images printed thereon tend to exhibit poor lightfastness. Furthermore, aramid fibers typically are more expensive than other synthetic fibers or natural fibers and, therefore, fabrics that are principally composed of such fibers typically are more expensive than those made from other synthetic or natural fibers.

In an effort to address the undesirable properties of fabrics made from such aramid fibers, others have attempted to develop fabrics using yarns comprising blends of aramid, natural, and synthetic fibers. While these efforts have met with varying degrees of success, a need still remains for a flame resistant fabric that exhibits improved print quality, lightfastness, and retains its flame resistance after repeated launderings.

The invention provides such a fabric and a process for producing the same. These and other advantages of the invention, as well as additional inventive features, will be apparent from the description of the invention provided herein.

BRIEF SUMMARY OF THE INVENTION

The invention provides a woven fabric comprising a plurality of first yarns and a plurality of second yarns, wherein the first yarns are disposed in a first direction in the woven fabric, the second yarns are disposed in a second direction in the woven fabric, and the second direction is substantially perpendicular to the first direction.

The invention further provides a process for producing a woven fabric comprising the steps of (a) providing a plurality of first yarns; (b) providing a plurality of second yarns; and (c) interlacing the pluralities of first and second yarns to produce a woven fabric, wherein the first yarns are disposed in a first direction in the woven fabric, the second yarns are disposed in a second direction in the woven fabric, and the second direction is substantially perpendicular to the first direction.

DETAILED DESCRIPTION OF THE INVENTION

The invention provides a woven fabric comprising a plurality of first yarns and a plurality of second yarns interlaced to provide a woven fabric. The first yarns are disposed in a first direction in the woven fabric, and the second yarns are disposed in a second direction in the woven fabric. Preferably, the first direction (i.e., the direction of the first yarns in the fabric) is substantially perpendicular to the second direction (i.e., the direction of the second yarns in the fabric). More specifically, the first yarns can be disposed in a first direction be selected from either the warp direction or the fill direction of the fabric, and the second yarns can be disposed in a second direction selected from the remaining one of the warp and fill directions of the fabric.

The first yarns comprise at least one natural fiber (i.e., a plurality of at least one type of natural fiber). Preferably, the first yarns comprise (or consist essentially of) a blend of natural fibers and synthetic fibers (e.g., a blend of at least one type of natural fiber and at least one type of synthetic fiber). The natural fiber contained in the first yarns can be any suitable natural fiber. Preferably, the natural fiber is a cellulosic fiber, such as a cotton fiber. The synthetic fiber, when present in the first yarns, can be any suitable synthetic fiber. Suitable synthetic fibers include, but are not limited to, nylon fibers, polyester fibers, vinyon fibers, olefin fibers, acrylic fibers, modacrylic fibers, spandex fibers, anidex fibers, carbon fibers, vinal fibers, and combinations thereof. Preferably, the synthetic fibers are nylon fibers, such as nylon 66 fibers, nylon 6 fibers, or a combination thereof.

Preferably, the first yarns are spun yarns comprised of staple fibers. The first yarns can be spun using any suitable spinning process, such as ring spinning, air-jet spinning, and open-end spinning. Preferably, the first yarns are spun using a ring spinning process (i.e., the first yarns preferably are ring spun yarns).

When the first yarns comprise a blend of natural and synthetic fibers, the first yarns can comprise any suitable amounts of the natural and synthetic fibers. Typically, each yarn of the first yarns comprises about 25 to about 75 wt. % natural fibers (e.g., cotton fibers), based on the total weight of each yarn. In a preferred embodiment, each yarn of the first yarns comprises about 30 to about 70 wt. % (e.g., about 35 to about 65 wt. % or about 38 to about 58 wt. %), more preferably about 40 to about 55 wt. % (e.g., about 43 to about 53 wt. %), and most preferably about 45 to about 50 wt. % (e.g., about 48 wt. %) natural fibers, based on the total weight of each yarn. With respect to the synthetic fiber content, each yarn of the first yarns typically comprises about 75 to about 25 wt. % synthetic fibers (e.g., nylon fibers), based on the total weight of each yarn. In a preferred embodiment, each yarn of the first yarns comprises about 30 to about 70 wt. % (e.g., about 35 to about 65 wt. % or about 42 to about 62 wt. %), more preferably about 45 to about 60 wt. % (e.g., about 47 to about 57 wt. %), and most preferably about 50 to about 55 wt. % (e.g., about 52 wt. %) synthetic fibers, based on the total weight of each yarn In a preferred embodiment, the first yarns further comprise static dissipative or antistatic fibers. The static dissipative or antistatic fibers can be any suitable fiber which helps to dissipate or inhibit the buildup of a substantial static charge in the fiber or a fabric containing the same. Suitable static dissipative fibers include, but are not limited to, carbon fibers, such as P140 antistatic carbon fibers commercially available from DuPont. When present in the first yarns, the static dissipative or antistatic fibers can be present in each of the yarns in an amount up to about 4 wt. % based on the total weight of each yarn. Preferably, the first yarns comprise about 0.5 to about 3 wt. % (e.g., about 1 to about 3 wt. % or about 1 to about 2 wt. %) static dissipative or antistatic fibers, based on the total weight of each yarn.

The second yarns comprise at least one aramid fiber (i.e., a plurality of at least one type of aramid fiber). As utilized herein, the term "aramid fiber" refers to a manufactured fiber in which the fiber-forming material is a long chain synthetic polyamide having at least 85% of its amide linkages directly attached to two aromatic rings. Suitable aramid fibers include, but are not limited to, meta-aramid fibers (e.g., NOMEX® fibers commercially available from DuPont), para-aramid fibers (e.g., KEVLAR® fibers commercially available from DuPont), and combinations thereof. Preferably, the second yarns comprise meta-aramid fibers (e.g., a plurality of at least one type of meta-aramid fibers). More preferably, the second yarns comprise (or consist essentially of) a blend of meta-aramid fibers and para-aramid fibers.

Preferably, the second yarns are spun yarns comprised of staple fibers. The second yarns can be spun using any suitable spinning process, such as ring spinning, air-jet spinning, or open-end spinning. Preferably, the second yarns are spun using an air-jet spinning process (i.e., the first yarns preferably are air-jet spun yarns).

As noted above, the second yarns comprise at least one type of aramid fiber. The second yarns can comprise any suitable amount of aramid fiber(s). Typically, each yarn of the second yarns comprises about 50 wt. % or more aramid fibers, based on the total weight of each yarn. Preferably, each yarn of the second yarns comprises about 50 wt. % or more meta-aramid fibers (e.g., NOMEX® fibers commercially available from DuPont), based on the total weight of each yarn. In a more preferred embodiment, each yarn of the second yarns comprises about 60 wt. % or more (e.g., about 70 to about 95 wt. %), more preferably about 80 wt. % or more (e.g., about 80 to about 95 wt. %), and most preferably about 90 wt. % or more (e.g., about 90 to about 95 wt. %, or about 92 to about 93 wt. %) meta-aramid fibers, based on the total weight of each yarn.

In certain embodiments, such as when each yarn of the second yarns comprises about 50 wt. % or more of a meta-aramid fiber, the second yarns can comprise a second aramid fiber (i.e., a second type of aramid fibers). For example, the second yarns can comprise para-aramid fibers (e.g., KEVLAR® fibers commercially available from DuPont). Such para-aramid fibers can be present in the second yarns in any suitable amount. For example, each yarn of the second yarns can comprise up to about 10 wt. % (e.g., about 1 to about 10 wt. %), preferably about 1 to about 5 wt. % (e.g., about 5 wt. %) para-aramid fibers, based on the total weight of each fiber.

In a preferred embodiment, the second yarns further comprise static dissipative or antistatic fibers. The static dissipative or antistatic fibers can be any suitable fiber which helps to dissipate or prevent a buildup of a substantial static charge in the fiber or a fabric containing the same. Suitable static dissipative fibers include, but are not limited to, carbon fibers, such as P140 antistatic carbon fibers commercially available from DuPont. When present in the second yarns, the static dissipative or antistatic fibers can be present in each of the yarns in an amount up to about 4 wt. % based on the total weight of each yarn. Preferably, the second yarns comprise about 0.5 to about 3 wt. % (e.g., about 1 to about 3 wt. %, or about 1 to about 2 wt. %) static dissipative or antistatic fibers, based on the total weight of each yarn.

The fabric can comprise any suitable amounts of the first and second yarns. For example, the plurality of first yarns typically comprises about 45 wt. % or more (e.g., about 50 wt. % or more) of the fabric, based on the total weight of the fabric. Preferably, the plurality of first yarns comprises about 50 to about 75 wt. % (e.g., about 52 to about 72 wt. %), more preferably about 55 to about 70 wt. % (e.g., about 57 to about 67 wt. %, about 60 to about 65 wt. %, or about 62 wt. %), of the fabric, based on the total weight of the fabric. The plurality of second yarns typically comprises about 20 wt. % or more (e.g., about 25 wt. % or more) of the fabric, based on the total weight of the fabric. Preferably, the plurality of second yarns comprises about 25 to about 50 wt. % (e.g., about 28 to about 48 wt. %), more preferably about 30 to about 45 wt. % (e.g., about 32 to about 43 wt. %, about 35 to about 40 wt. %, or about 38 wt. %) of the fabric, based on the total weight of the fabric.

The woven fabric can be woven in any suitable pattern. Preferably, the fabric is woven in such a pattern that a face of the fabric (e.g., the face of the fabric to which a printed image will be applied) has more of the first yarns exposed than second yarns. For example, when the first yarns are provided in the warp direction of the fabric, the fabric can be woven in a warp-faced twill weave, such as a 2/1, 3/1; 3/2, or 4/1 twill weave, or a warp-faced sateen Weave. Alternatively, if the first yarns are provided in the fill direction of the fabric, the fabric can be woven in a fill-faced twill weave or a fill-faced sateen weave.

The fabric can comprise any suitable number of the first and second yarns per inch of fabric. In certain embodiments, the woven fabric comprises about 60 to about 100 (e.g., about 80 to about 100, or about 90 to about 100) of the first yarns per inch of fabric in the first direction. In certain other embodiments, the woven fabric comprises about 30 to about 60 (e.g., about 35 to about 55, or about 40 to about 50) of the second yarns per inch in the second direction.

The woven fabric of the invention can have any suitable weight. For example, when the woven fabric is intended to be worn as a garment (e.g., a battle dress uniform), the fabric typically has a weight of about 10 ounces per square yard or less. Preferably, the woven fabric has a fabric weight of about 3 to about 10, more preferably about 4 to about 8, ounces per square yard. However, those of ordinary skill in the art will readily appreciate that the woven fabric can have a higher weight, for example, when the fabric is intended to be used to produce a coat or other outerwear.

The invention further provides a process for producing a woven fabric comprising the steps of (a) providing a plurality of first yarns, (b) providing a plurality of second yarns, and (c)

interlacing the pluralities of first and second spun yarns to produce a woven fabric, wherein the plurality of first spun yarns are disposed in a first direction in the woven fabric, the plurality of second spun yarns are disposed in a second direction in the woven fabric, and the second direction is substantially perpendicular to the first direction. The first and second yarns suitable for use in the above-described method can be the same as those set forth above for the woven fabric of the invention.

In certain embodiments, the process of the invention further comprises the step of applying a flame retardant finish to a surface of the woven fabric. Any suitable flame retardant finish can be applied to the surface of the woven fabric. For example, a flame retardant finish comprising an ammonium salt of phosphoric acid can be applied to the surface of the fabric. The process for applying such a finish to the surface of a fabric is described in U.S. Pat. No. 3,900,664 (Miller), which is hereby incorporated by reference. The flame retardant finish can be applied to the surface of the fabric at any suitable point in its production. For example, the flame retardant finish can be applied before or after the fabric is dyed or printed with a suitable image. Preferably, the flame retardant finish is applied before the fabric is dyed or printed so that the color obtained by the dying or printing process is the final color of the fabric. In other words, applying the flame retardant finish before the fabric is dyed or printed avoids any color changes that might be produced by the application of the flame retardant finish to the fabric.

In certain embodiments, the process of the invention further comprises the step of dyeing the fabric or printing an image on a surface of the fabric. The fabric can be dyed or printed in any suitable manner, such as screen printing.

The following example further illustrates the invention but, of course, should not be construed as in any way limiting its scope.

EXAMPLE

This example demonstrates the improved abrasion resistance, lightfastness, and flame resistance exhibited by a fabric according to the invention. A woven fabric (Sample 1) was produced by interlacing a plurality of first and second yarns. The first yarns, which were disposed in the warp direction of the fabric, comprised a blend of approximately 48.4 wt. % cotton fibers and approximately 51.6 wt. % nylon fibers, based on the total weight of each yarn. The first yarns were ring spun, single ply yarns having a cotton count of 20. The second yarns, which were disposed in the fill direction of the fabric, comprised a blend of approximately 93 wt. % meta-aramid fibers (i.e., NOMEX® fibers commercially available from DuPont), approximately 5 wt. % para-aramid fibers (i.e., KEVLAR® fibers commercially available from DuPont), and approximately 2 wt. % static dissipative fibers (i.e., P140 antistatic carbon fibers commercially available from DuPont). The blend used as the second yarns is commercially available from DuPont as staple fiber sold under the trade name Type 462 NOMEX®. The second yarns were jet spun, two ply yarns having a cotton count of 30. The plurality of first and second yarns were woven in a 3/1 warp-faced twill weave, which comprised approximately 62 wt. % of the first yarns and approximately 38 wt. % of the second yarns, based on the total weight of the fabric. The resulting fabric had a fabric weight of approximately 6.42 ounces per square yard, contained approximately 98 ends per inch, and contained approximately 46 picks per inch. The fabric was then printed with a camouflage print.

Sample 1 was then tested to determine the abrasion resistance, lightfastness, and flame resistance of the woven fabric. The abrasion resistance of the fabric, expressed in terms of the flex abrasion, was measured in accordance with ASTM Standard D3885-99, entitled "Standard Test Method for Abrasion Resistance of Textile Fabrics (Flexing and Abrasion Method)." The light fastness of the fabric was measured in accordance with AATCC Test Method 16E-2004, entitled "Colorfastness to Light." The flame resistance of the fabric was measured in accordance with ASTM Standard F1930-00, entitled "Standard Test Method for Evaluation of Flame Resistant Clothing for Protection against Flash Fire Simulations Using an Instrumented Manikin," hereinafter referred to as the "Pyroman" test. The results of each of these measurements for Sample 1 are set forth in Table 1 below.

For purposes of comparison, the same tests were performed on two "all-aramid" fabrics (Sample 2 and Sample 3) currently being used in certain military uniforms. Sample 2 was a plain woven fabric comprising warp and fill yarns containing a blend of approximately 92 wt. % meta-aramid fibers (i.e., NOMEX® fibers commercially available from DuPont), approximately 5 wt. % para-aramid fibers (i.e., KEVLAR® fibers commercially available from DuPont), and approximately 3 wt. % static dissipative fibers (i.e., P140 antistatic carbon fibers). Sample 2 had a fabric weight of approximately 5.78 ounces per square yard, contained approximately 70 ends per inch, and contained approximately 54 picks per inch. Sample 2 was printed with a camouflage print. Sample 3 was a plain woven fabric comprising warp and fill yarns containing a blend of approximately 92 wt. % meta-aramid fibers (i.e., NOMEX® fibers commercially available from DuPont), approximately 5 wt. % para-aramid fibers (i.e., KEVLAR® fibers commercially available from DuPont), and approximately 3 wt. % static dissipative fibers (i.e., P140 antistatic carbon fibers). Sample 3 had a fabric weight of approximately 4.35 ounces per square yard, contained approximately 70 ends per inch, and contained approximately 49 picks per inch. The yarns contained in Sample 3 were solution dyed. The results of the abrasion resistance, lightfastness, and flame resistance measurements for Samples 2 and 3 are also set forth in Table 1 below.

TABLE 1

Abrasion resistance, lightfastness, and flame resistance for Samples 1-3.

| | Sample 1 | Sample 2 | Sample 3 |
|---|---|---|---|
| Flex Abrasion (Warp) | 29979 | 4109 | 4517 |
| Flex Abrasion (Fill) | 13768 | 5608 | 3827 |
| Pilling (90 min.) | 4.5 | 4.5 | 1.5 |
| Lightfastness (100 hrs.) | 4.5 | 1.0 | 1.5 |
| Pyroman (3 sec. burn) | 3.01 | — | 9.01 |
| Pyroman (4 sec. burn) | 19.67 | — | 23.77 |

As evidenced by the data set forth in Table 1, the fabric of the invention (Sample 1) exhibits improved flex abrasion in both the warp and fill directions relative to Samples 2 and 3. In particular, the flex abrasion of Sample 1 in the warp direction is at least about six (6) times greater than the flex abrasion of Samples 2 and 3 in the warp direction. The data further demonstrates that the fabric of the invention (Sample 1) exhibits improved lightfastness, after 100 hours of continuous exposure to a xenon arc lamp, when compared to Samples 2 and 3. Lastly, the data demonstrates that the fabric of the invention (Sample 1) exhibits improved flame resistance relative to Sample 3 when measured using the Pyroman test, which better simulates the effectiveness of a fabric in preventing or reducing serious burns to an individual wearing a garment made from the fabric. In particular, the fabric of the invention (Sample 1) exhibits a percent body burn (following a 3 second burn) that is approximately one-third of the value obtained for Sample 3 under the same conditions. The fabric of the invention (Sample 1) also exhibits a lower percent body burn than Sample 3 following a 4 second burn.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A woven fabric, the fabric comprising:

(a) a plurality of first spun yarns, the first spun yarns comprising a blend of cotton fibers and nylon fibers, the first spun yarns comprising about 45 to about 50 wt. % cotton fibers and about 50 to about 55 wt. % nylon fibers, based on the total weight of each yarn; and (b) a plurality of second spun yarns, the second spun yarns comprising about 90 wt. % or more meta-aramid fibers, based on the total weight of each yarn;

wherein the first spun yarns are disposed in a first direction in the woven fabric, the second spun yarns are disposed in a second direction in the woven fabric, and the second direction is substantially perpendicular to the first direction.

2. The woven fabric of claim 1, wherein the second spun yarns further comprise para-aramid fibers.

3. The woven fabric of claim 1, wherein the first and second spun yarns further comprise static dissipative fibers.

4. The woven fabric of claim 3, wherein each yarn of the pluralities of first and second yarns comprises about 1 to about 3 wt. % static dissipative fibers, based on the total weight of each yarn.

5. The woven fabric of claim 1, wherein the woven fabric has a warp direction and a fill direction, and the first direction is the warp direction of the woven fabric.

6. The woven fabric of claim 5, wherein the fabric is woven in a warp-faced twill weave or a warp-faced sateen weave.

7. The woven fabric of claim 6, wherein the weave is a warp-faced twill weave selected from the group consisting of 2/1, 3/1, 3/2, and 4/1 twill weaves.

8. The woven fabric of claim 1, wherein the plurality of first yarns comprises about 50 to about 75 wt. % of the fabric, based on the total weight of the fabric.

9. The woven fabric of claim 1, wherein the plurality of second yarns comprises about 25 to about 50 wt. % of the fabric, based on the total weight of the fabric.

10. The woven fabric of claim 1, wherein the woven fabric comprises about 60 to about 100 of the first yarns per inch in the first direction and about 30 to about 60 of the second yarns per inch in the second direction.

11. The woven fabric of claim 1, wherein the woven fabric has a fabric weight of about 4 to about 8 ounces per square yard.

* * * * *